US007648297B2

(12) United States Patent
Kaufmann

(10) Patent No.: US 7,648,297 B2
(45) Date of Patent: Jan. 19, 2010

(54) WRITING UTENSIL

(75) Inventor: Rainer Kaufmann, Delmenhorst (DE)

(73) Assignee: edding AG, Ahrensburg (DE)

( * ) Notice: Subject to any disclaimer, the term of this patent is extended or adjusted under 35 U.S.C. 154(b) by 68 days.

(21) Appl. No.: 11/913,088

(22) PCT Filed: May 10, 2006

(86) PCT No.: PCT/EP2006/004393

§ 371 (c)(1),
(2), (4) Date: Oct. 30, 2007

(87) PCT Pub. No.: WO2006/122693

PCT Pub. Date: Nov. 23, 2006

(65) Prior Publication Data

US 2008/0193199 A1 Aug. 14, 2008

(30) Foreign Application Priority Data

May 14, 2005 (DE) ..... 10 2005 022 462

(51) Int. Cl.
*B43K 5/00* (2006.01)

(52) U.S. Cl. ..... 401/206; 401/205

(58) Field of Classification Search ..... 401/198, 401/199, 205, 206, 217
See application file for complete search history.

(56) References Cited

U.S. PATENT DOCUMENTS

| | | | | |
|---|---|---|---|---|
| 2,624,902 | A * | 1/1953 | Soldner | 401/206 |
| 4,764,044 | A * | 8/1988 | Konose | 401/150 |
| 6,027,274 | A * | 2/2000 | Seddon et al. | 401/206 |
| 6,675,650 | B1 | 1/2004 | Paulo | |

FOREIGN PATENT DOCUMENTS

| | | |
|---|---|---|
| DE | 40 15 586 C3 | 4/1997 |
| GB | 2 310 592 | 5/1996 |
| WO | 93/05966 | 4/1993 |

* cited by examiner

*Primary Examiner*—David J Walczak
(74) *Attorney, Agent, or Firm*—Vidas, Arrett & Steinkraus, P.A.

(57) ABSTRACT

A writing utensil for a free-flowing writing fluid, comprising a closed reservoir with the writing fluid therein that has an outlet aperture for the writing fluid and a further aperture, an elongate writing tip which communicates with the outlet aperture of the reservoir and is slidably supported, and a valve which is disposed inside a communicating path between the writing tip and reservoir and interacts with the writing tip so as to cause the valve to open the communicating path if a force acts onto the writing tip, wherein the further aperture connects the reservoir to the surroundings via an air line.

15 Claims, 4 Drawing Sheets

WRITING UTENSIL

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a writing utensil for a free-flowing writing fluid. The text which now follows refers to a writing utensil which is also suited for use in drawing, depicting, and marking things. In particular, writing utensils in the sense of the application also comprise markers, highlighters, felt tip pens and the like.

From GB 2 310 592, the entire contents of which is incorporated herein by reference, a marker is known which has a valve for the control of liquid passage into a supply duct from a reservoir. The supply duct extends up to a marker tip through a feeding element. The feeding element is of a retractable configuration in order to open the valve when the marker tip is urged against a surface. An auxiliary chamber is provided between the valve member, which is formed as a sphere, and the feeding element. The forechamber is sealingly closed by an elastic membrane in such a way that if the pressure on the writing tip lessens the membrane returns to its initial position while pulling the valve member back into the valve seat.

DE 40 15 586 C3, the entire contents of which is incorporated herein by reference, has made known an utensil for applying a fluid for writing, depicting, printing or drawing things or the like, which has a liquid container, a writing tip, and an air, supply tube which connects the container interior to the outer atmosphere. In addition, a capillary liquid tank is provided which is formed as a fluid-conveying device. In the known utensil, the fluid-conveying device completely extends through the interior of the tank. The air supply tube additionally is filled with a capillary material to prevent liquid from leaking via the tube.

From U.S. Pat. No. 6,575,650 B1, the entire contents of which is incorporated herein by reference, a pencil is known in which the ink is discharged through a valve. A writing tip is disposed to be longitudinally displaceable in the front portion of the pencil. While writing is done the writing tip is pushed back and the valve opens so that ink may be fed to the writing tip. At the same time, the ink inflow to the valve is blocked by a head of the retracted writing tip so that merely a predetermined amount of ink is supplied to the writing tip. If this amount of ink is used up the pencil needs to be lifted off in order that the valve be closed again and fresh ink may flow to the valve again.

WO 93/05966, the entire contents of which is incorporated herein by reference, has made known a writing utensil the reservoir of which connects to the surroundings via a through bore. The writing fluid is sealed from the through bore by means of a movable plug.

It is the object of the present invention to provide a leak-proof writing utensil which, by using simple means, creates a continuous flow of writing fluid.

BRIEF SUMMARY OF THE INVENTION

The inventive writing utensil is suited for use with inks. However, the invention is not at all limited to use with inks, but may be employed for any writing fluids specifically including varnishes, and writing fluids containing or not containing pigments. The writing utensil has a closed reservoir for the writing fluid that is provided with an outlet aperture for the writing fluid and a further aperture. The ink exists is available a free-flowing fluid, a so-called free ink system, in the reservoir. The writing utensil further has an elongate writing or marking tip which communicates with the reservoir via a communicating path and is slidably supported along its longitudinal axis. For simplicity, the tip of the writing utensil is will hereinafter be referred to as a writing tip. The communicating path connects the reservoir, to the writing tip via the outlet aperture. Further, the writing utensil has provided therein a valve which is disposed inside the fluid duct. The valve interacts with the writing tip so as to cause the valve to open the fluid duct if a force acts onto the writing tip towards the reservoir. When the valve is open the communicating path is free and writing fluid will enter the writing tip from the reservoir. The further aperture in the reservoir is in communication with the surroundings via an air line. The opened valve inside the communicating path ensures a continuous stream of writing fluid into the writing tip. The air line for communication with the surroundings avoids a stagnation of the writing fluid flow caused by a negative pressure which has been formed by the exiting writing fluid in the reservoir. The air line further serves for pressure compensation if a volume variation occurs in the reservoir, because of temperature fluctuations, for example. This makes the writing utensil leak-proof to a large extent. The force necessary to open the valve is from 0.05 N to 5 N, preferably 0.1 N to 0.4 N. In a particularly preferred aspect, the force necessary to open the valve already matches the weight force caused by placing the writing utensil onto a supporting structure.

In a preferred aspect, a flow limiter is provided between the reservoir and writing tip. Here, the flow limiter is dimensioned so as to create a continuous volume of writing fluid for the intended writing fluid. Since the writing fluid in the reservoir is always exposed to atmospheric pressure it becomes possible to dimension the flow limiter much more precisely than in writing utensils where the writing fluid is subjected to differing pressures. For example, the flow limiter is configured as a duct portion of a small diameter. Preferably, the valve can have a bendable valve plate which sealingly bears against a holder. The writing tip is attached to the valve plate where the pressure applied to the writing tip pushes the valve plate out of the sealing position and writing fluid is allowed to flow in again through the flow limiter from the reservoir.

In a preferred aspect, a capillary balance tank can additionally be provided between the valve and writing tip. The capillary balance tank serves for accumulating and storing any excess of ink which still has passed through prior to the closure of the valve, but is no longer needed, for example. The capillary balance tank is disposed such that ink from the air line is collected by the balance tank as well.

The air line leading to the interior of the reservoir preferably is configured as a rigid tube element. It is preferred here that the air line has its mouth into a volume centre of the reservoir here. In a rotationally symmetric ink reservoir, the volume centre is located on the axis of symmetry at half its level, for example, with the reservoir being filled to less of its half-level.

To exclude a leakage of writing fluid via the air line to a very large degree, the mouth of the air line is disposed inside the reservoir such that the air line always is in communication with the surroundings in all of the positions at a predetermined filling volume of the reservoir. In order that such a position exists for the air line the reservoir must not be filled with writing fluid up to more than its half-level and, preferably, is filled with writing fluid to less of its half-level.

In a particularly expedient aspect, the reservoir is of an approximately cylindrical shape with the outlet aperture of the reservoir and the further aperture being provided at the bottom of the reservoir.

In an expedient aspect, the valve is biased to its closing position and will open as soon as a predetermined force is transmitted to the valve member from the writing tip. The valve may serve as a flow limiter as well. However, it is also conceivable to configure the valve and the flow limiter as separate components where the flow limiter may also be configured as a duct of a reduced diameter and a corresponding length.

To ensure a continuous flow of writing fluid, the size of the flow limiter is such that if the writing tip points downwards the writing fluid will pass through in a volume as is required for a regular flow of writing fluid. Hence, the flow limiter is designed for the regular functions of writing, depicting, drawing, and marking things. In contrast to other free-ink systems, the writing fluid is not sucked from the reservoir, by means of the adhesion power of the writing pad, but substantially flows to the writing tip by the influence of gravity.

The preferred area of lift is the one in which the writing tip restricts by additional means. It is preferred to restrict the lift to 0.01 to 0.4 mm, preferably 0.05 to 0.2 mm. Like the force necessary to open the valve, the lift should be so small that a user does not become aware that the valve is opening.

BRIEF DESCRIPTION OF THE SEVERAL VIEWS OF THE DRAWINGS

Several embodiments of the inventive writing utensil will be explained in more detail below by way of one embodiment. In the figures.

DETAILED DESCRIPTION OF THE INVENTION

Figure 1:
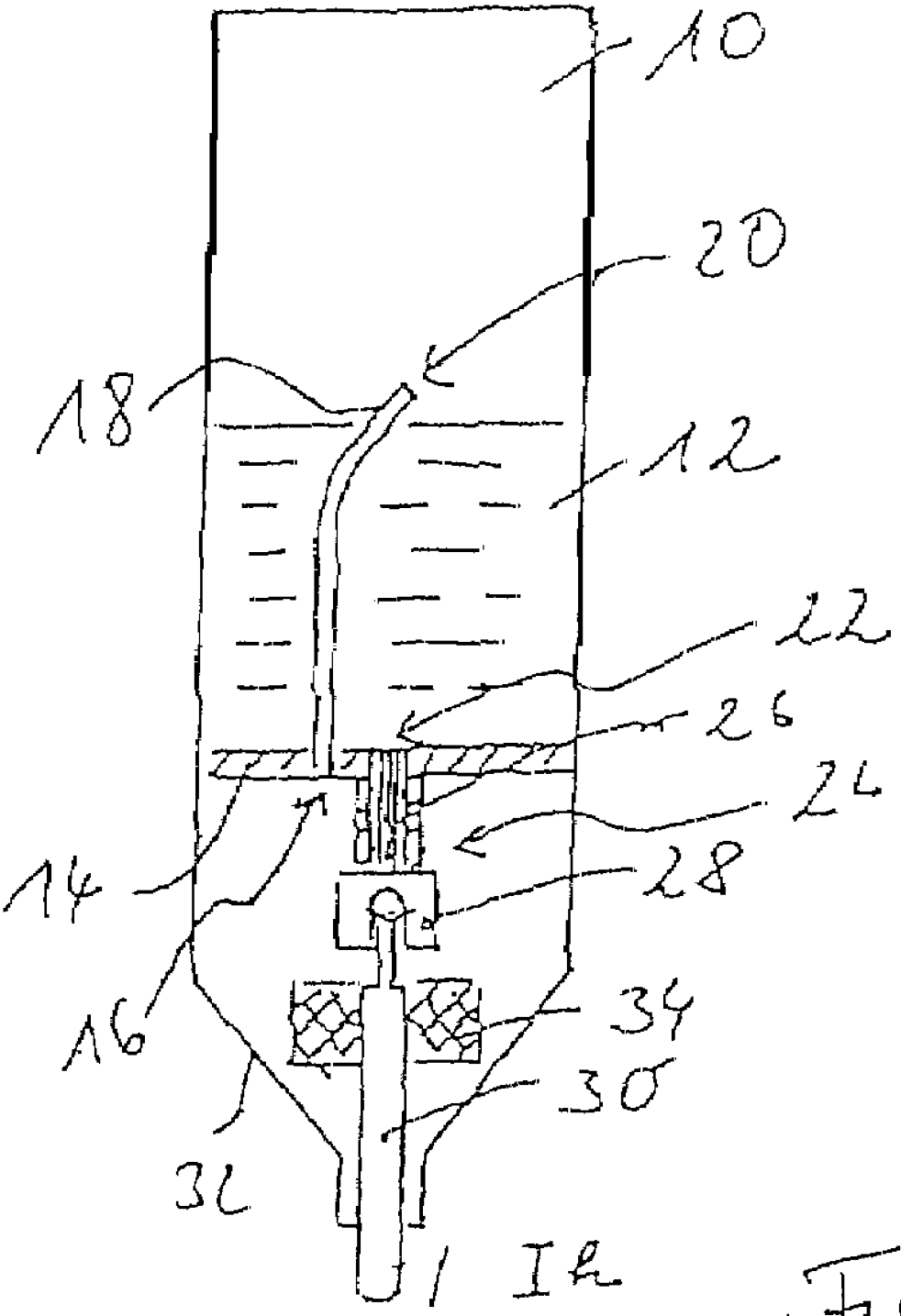
FIG. 1 shows a cross-section through a first embodiment.

While this invention may be embodied in many different forms, there are described in detail herein a specific preferred embodiment of the invention. This description is an exemplification of the principles of the invention and is not intended to limit the invention to the particular embodiment illustrated FIG. 1 shows a writing utensil designed as a marker in a schematic view. The writing utensil concerned may be a varnish marker, for example. The writing utensil has a reservoir 10 which contains an ink 12. The reservoir 10 need not necessarily define the body of the pencil. Rather, it is imaginable to provide a pencil body inside which the reservoir 10 is arranged. In the embodiment shown, the reservoir 10 is confined by a bottom plate 14 while the outer wall of the reservoir 10 extends beyond the bottom plate 14 up to the writing tip.

The bottom plate 14 has an eccentrically disposed air port 16 onto which an air line 18 is placed. In a first portion, the air line 18 extends in parallel with the longitudinal axis of the reservoir 10. The air line 18 is deflected in the area of its mouth 20 and terminates in the volume centre of the reservoir 10. Here, the volume centre designates the point which is always free if the reservoir is filled to slightly less than to its half-level and is not covered with fluid in any position of the reservoir. In a cylinder, for example, the volume centre is the centre of the cylinder so that a cylinder filled slightly less than to its half-level will not cover the volume centre in any position.

The bottom plate 14 further has a central opening 22 which has its mouth into a fluid duct. The fluid duct, as a communicating path between the reservoir and writing tip, extends centrally through the writing utensil in the example shown. The bottom plate 14 is directly followed by a flow limiter 26. The flow limiter 26 constricts the passage duct to a cross-section such as to form a stream of writing fluid which matches the regular volume of writing fluid. The flow limiter is disposed in the way of a throttle from the writing tip and limits the volume flow of writing fluid from the reservoir. The further quantity determining the flow rate is the length of the capillary, which is also set to the desired flow rate.

Downstream of the flow limiter 26, a valve 28 is provided which, when in its closed position, shuts off the passage of writing fluid. The valve 28 is configured as a valve having a valve member and a valve seat, the valve member communicating with the marker tip 30. The marker tip 30 moves the valve member out of the valve seat, thus releasing the flow of writing fluid into the writing tip 30 from the flow limiter. Further, the valve is equipped with elastic resetting means (not shown) which apply a resetting force to the valve member and, hence, the writing tip.

Figure 2:
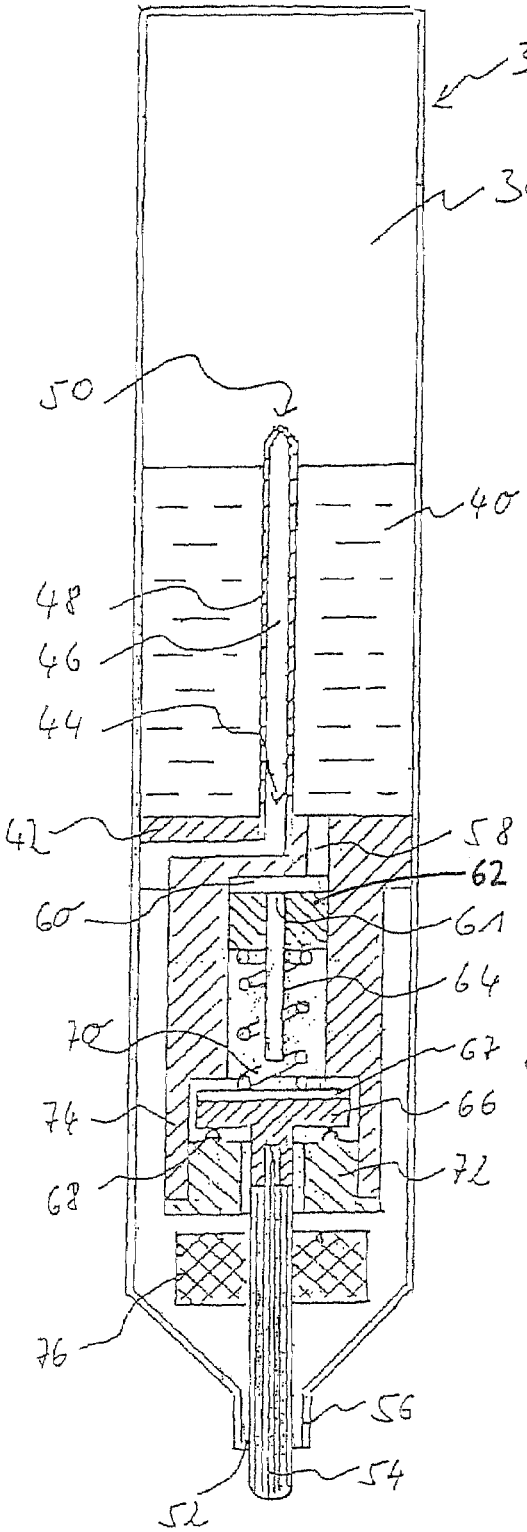
FIG. 2 shows a cross-section through a second embodiment.

The writing tip 30 protrudes from the casing 32 at its distant end. At the internally located end of the writing tip 30, a balance tank 34 is provided which accumulates an excess of writing fluid. The lift h, which is needed to completely actuate the valve, preferably is 0.2 mm or less. The force necessary therefore is 0.2 N, FIG. 2 shows a cross-section through a second embodiment of an inventive writing utensil. A reservoir 38 in which a writing fluid 40 is provided is bordered by a wall 32. The bottom of the reservoir 38 is confined by a bottom element 42 which has a central air discharge port 44. The air discharge port 44 is located inside an air discharge duct 46 which is confined by an air discharge tube 48. The discharge tube 48 centrally projects into the reservoir 38 and, at its free end, has an opening 50 which connects the reservoir interior 38 to the air discharge duct 46. Below the bottom plate 42, the air discharge duct 46 runs at an angle and leads to the area of the writing tip where an annular gap 52 is provided to connect to the surroundings. The annular gap 52 is defined by a space between the writing tip 54 and the pertinent wall portion 56 of the writing utensil. The reservoir interior 38 communicates with the surroundings via the air discharge duct 46 and pressure compensation is performed.

The bottom element 42 has a second opening 58 which connects the reservoir 38 of the writing fluid 40 to a forechamber 60. The forechamber 60 has an outlet port 61 which is formed inside a holding element 62. The outlet port 61 is joined by a flow limiter 64 designed as a small tube through which the writing fluid 40 is led out of the forechamber 60. The flow limiter restricts the flow rate which runs through the smaller cross-section of the opening and the length of the small tube.

Downstream of the flow limiter, the valve including a valve member 66 and an annular valve seat 68 is provided. On its side facing away from the valve, the valve member 66 has indentations 67 which allow for a flow of the writing fluid when the valve is opened. A helical spring 70 is disposed around the flow limiter 64 and is supported on the bottom element 42.

The valve seat 68 is configured as a circumferential protrusion which is formed on a separate structural component 72. The structural component 72 for the valve seat 68 is placed in a central recess of a lug 74, the lug being possibly formed integrally with the bottom plate 42.

The marking tip 54 is connected to the valve member 66 formed as a valve tappet. A capillary balance tank 76 is disposed around the marking tip 54.

Figure 3:
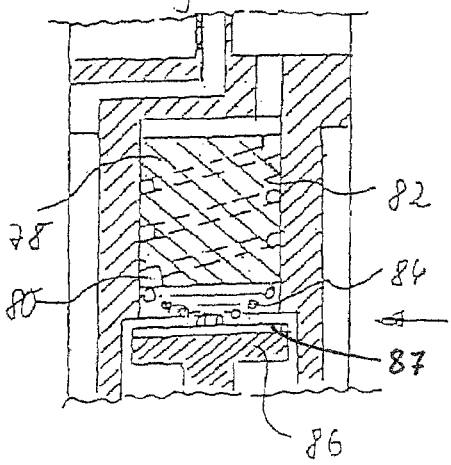
FIG. 3 shows an alternative embodiment of the valve in a cross-sectional drawing.

The marking tip 54 centrally projects from the tip of the writing utensil. Any writing fluid that got into the air discharge duct 46 is fed to the marking tip via the capillary tank in the area of the wall 56 so as to efficiently prevent it from leaking FIG. 3 shows an alternative aspect of the flow limiter. Here, a bottom element 78 is provided which forms a helical outlet duct 80 therein The outlet duct 80 extends inside the element 78 along the outside so that the duct is outwardly confined by the inner wall 82 of the accommodation aperture for the element 78. In the position shown, a spring 84 urges the valve tappet 86 and the writing tip into the closed position. The valve tappet 86 is provided with recesses 87 which allow a writing fluid to pass through even if the valve tappet is pushed back.

Figure 4:
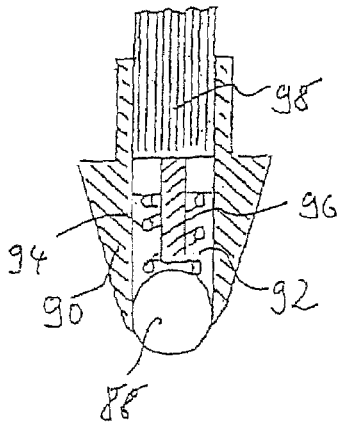
FIG. 4 shows a further embodiment of the valve in a cross-sectional drawing.

FIG. 4 shows an alternative aspect of the valve where the valve member is defined by a roller ball 88. The roller ball 88 is seated in a tip 90 which has a central guide channel 92 for the roller ball 88. The roller ball 88 is retained in the channel by a constriction of the cross-section in the free end of the guide channel. The roller ball is urged to its closed position by a helical spring 94. The movement of the roller ball 88 within the guide channel 92 is limited in the opposed direction by means of a stop 96. The maximum lift of the roller ball is defined by the distance between the roller ball 88 and the stop 96 in the closed position. The writing fluid is supplied to the roller ball 88 through a wick 98.

Figure 5:
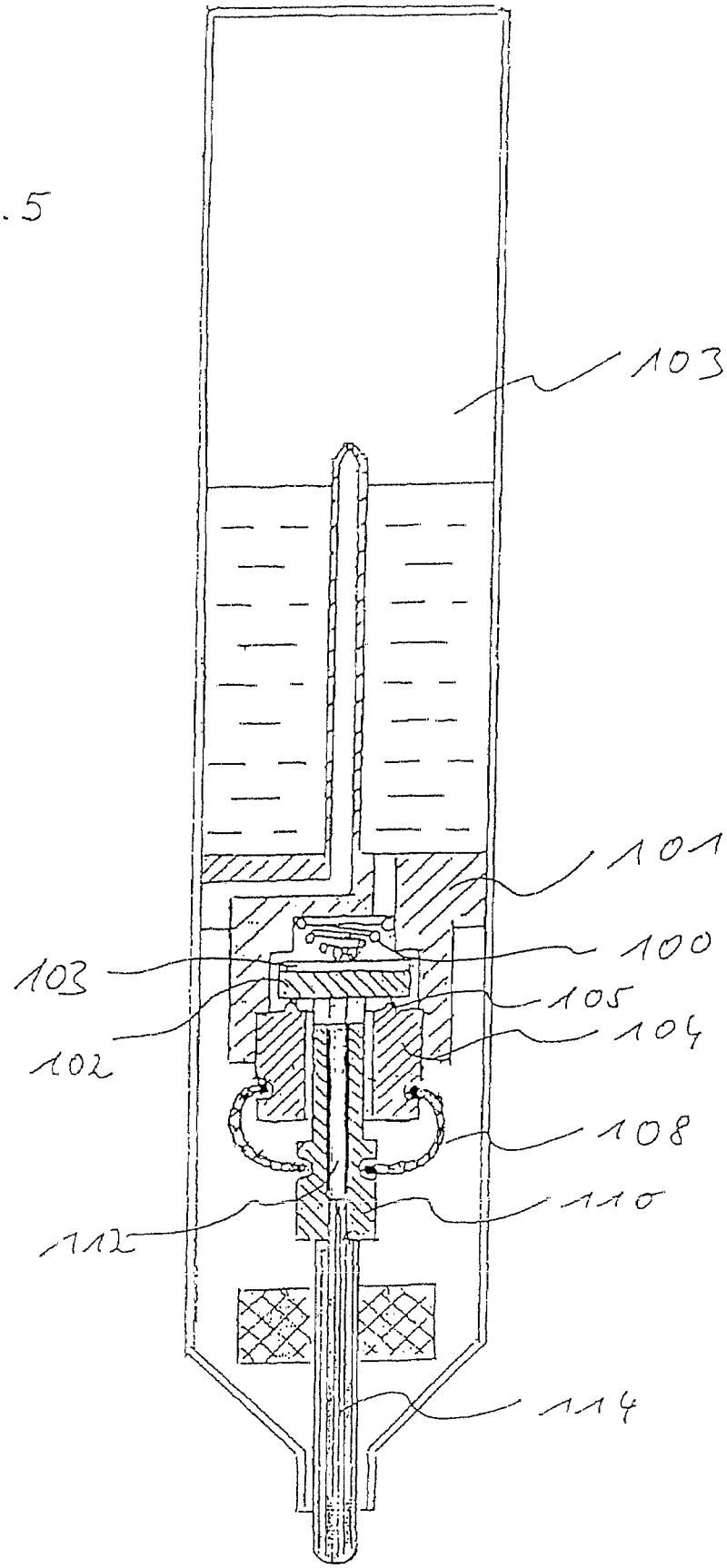
FIG. 5 shows a further embodiment of the inventive writing utensil.

FIG. 5 shows a further embodiment where the sequence of the valve and flow limiter is exchanged. A spring 100 is disposed in a base plate 101 of the reservoir 103 in a stationary way. The spring 100 bears on a valve tappet 102 which sealingly interacts with a valve seat 104. The side facing away from the valve seat 104 is provided with recesses 103 which keep the communicating path free for the writing fluid. The valve seat 104 is also disposed in a stationary way relative to the bottom element 101 and has an annular bulge 105 A flow limiter 110 is slidably held via a bellows 108 inside the stationary valve seat 104. The bellows 108 seals the transition area to the flow limiter here as ink gathers in the bellows and, thence, gets into the flow limiter. The flow limiter 110 has a flow duct 112 which is dimensioned for the passage of a writing fluid. The marking tip 114 proceeds directly from the flow duct 112 of the flow limiter 110.

The bellows 108 has its ends arranged each in a circumferential groove of the valve seat 104 and flow limiter 110. Preferably, the ends of the bellows 108 are clampingly disposed in the groove.

Figure 6:
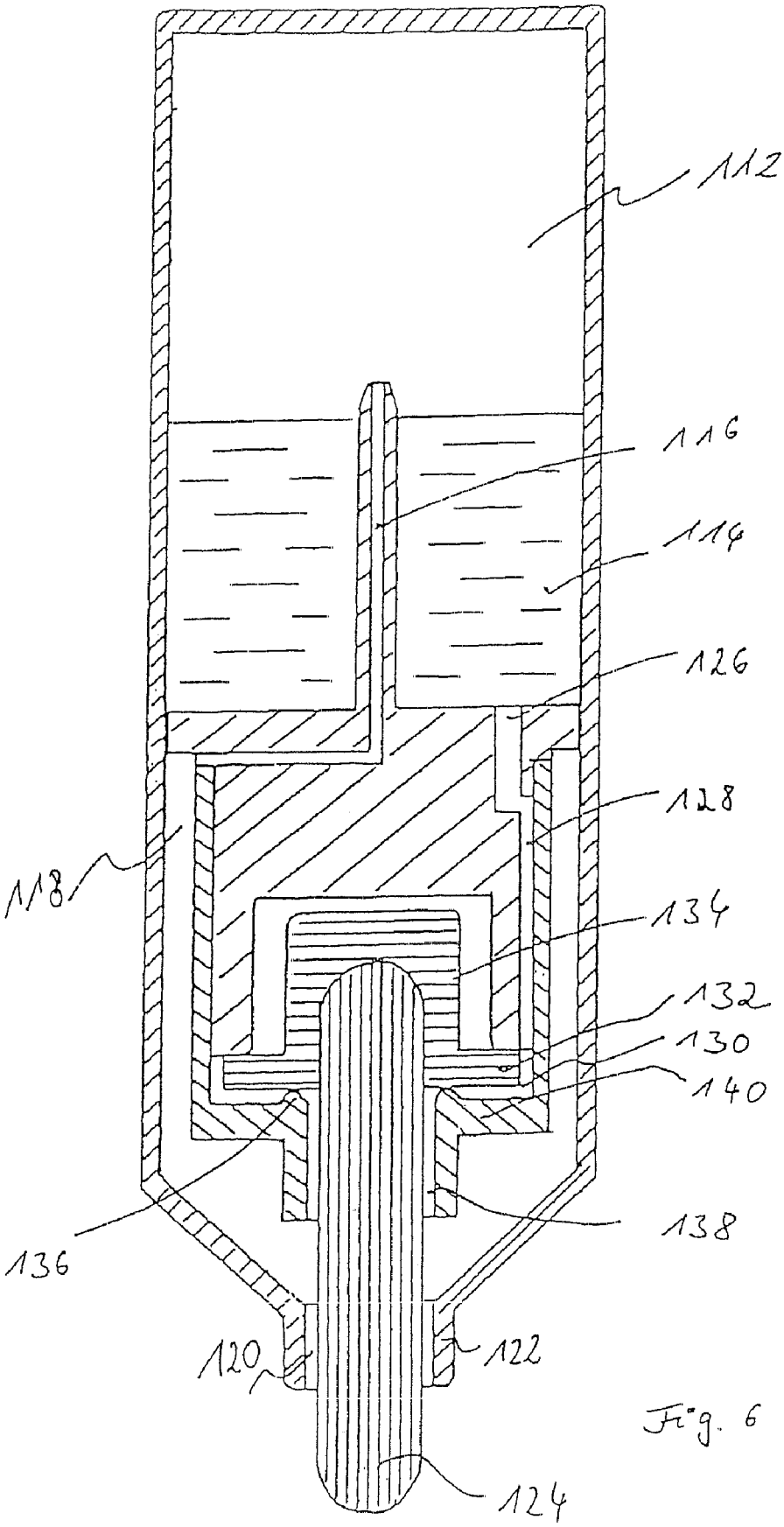
FIG. 6 shows a further embodiment including a bendable valve plate.

FIG. 6 shows a further embodiment of the inventive writing utensil in a cross-section. The writing utensil has a fluid reservoir 112 which is filled with a writing fluid 114 to less than the half-level. Centrally protruded into the reservoir 112 is an air line 116 which communicates with the surroundings via an air duct 118. Here, the air line 116 projects into the reservoir, 112 from the lower and. The air duct 118 communicates with the surroundings via an annular gap 120. The annular gap is confined outwardly by an annular casing portion 122. Inwardly, the annular gap 120 is confined by the fibrous tip 124. The specific advantage is to be seen here in that any writing fluid that gets into the air line and air duct 118 can be imbibed by the marker tip 120 while traversing the air gap. This avoids any unnecessary leakage of ink.

The writing fluid 114 gets into a duct-shaped flow limiter 128 through an opening 126. The flow limiter 128 is of a length and diameter which are chosen so as to match the passage of writing fluid with the desired volume of writing fluid at the writing tip. The flow limiter 128 extends inside an annular valve chamber 130. The valve chamber 130 is sealed by an elastic valve plate 132. The valve plate 132 has a central holder portion 134 into which the fibrous tip 124 is inserted. The elastic valve plate 132 interacts with a bulge 136. The bulge is formed annularly around a guide channel 138 on a valve seat plate 140. The guide channel 138 also serves as a guide of the fibrous tip 124. In the opened position, i.e. the position in which an inward force acts onto the fibrous tip 124, the valve plate 132 is flexed back and an annular gap forms between the bulge 136 und the plate 132.

Apart from the flow limitation caused by the interaction of the bulge lip 136 und the elastic valve plate 132, a flow limitation also takes place by the duct portion 128 as was mentioned previously. As can be clearly seen in FIG. 6 the outlet duct diminishes in diameter so that there will be a limitation of flow.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A writing utensil for a free-flowing writing fluid, comprising:

a closed reservoir with the free-flowing writing fluid therein that has an outlet aperture for the writing fluid and a further aperture, an elongate writing tip which communicates with the outlet aperture of the reservoir and is slidably supported, and a valve which is disposed inside a communicating path between the writing tip and reservoir and interacts with the writing tip so as to cause the valve to open the communicating path if a force acts onto the writing tip, wherein the further aperture connects the reservoir with a surroundings via an air line, characterized in that a flow limiter is provided inside the communicating path between the reservoir and writing tip upstream of the valve, and the air line is disposed inside the reservoir such that the air inside the reservoir always is in communication with the surroundings via the air line, in all of the positions of the writing utensil, up to a predetermined filling volume.

2. The writing utensil according to claim 1, characterized in that the minimum force necessary to open the valve is from 0.05 N to 5 N.

3. The writing utensil according to claim 1, characterized in that the minimum force necessary to open the valve is from 0.1 N to 0.3 N.

4. The writing utensil according to claim 3, characterized in that the minimum force necessary to open the valve is 0.2 N.

5. The writing utensil according to claim 1, characterized in that a capillary balance tank is provided between the valve and writing tip.

6. The writing utensil according to claim 1, characterized in that the air line has a substantially rigid tube element.

7. The writing utensil according to claim 1, characterized in that the air line has a mouth into the volume centre of the reservoir.

8. The writing utensil according to claim 1, characterized in that the reservoir is of an approximately cylindrical shape.

9. The writing utensil according to claim 1, characterized in that the reservoir has a bottom in which the outlet aperture and the further aperture are provided.

10. The writing utensil according to claim 1, characterized in that the valve, when in a closing position, is biased and opens, starting at a minimum force acting onto the writing tip.

11. The writing utensil according to claim 1, characterized in that the writing tip is slidably supported within an area of lift for the actuation of the valve.

12. The writing utensil according to claim 11, characterized in that the writing tip has a lift of from 0.01 to 0.4 mm.

13. The writing utensil according to claim 12, characterized in that the writing tip has a lift of from 0.05 to 0.2 mm.

14. The writing utensil according to claim 1, characterized in that the flow limiter is tubular and is provided inside the communicating path between the reservoir and writing tip.

15. The writing utensil according to claim 1, characterized in that an elastic valve plate centrally carries the writing tip which, when acted on by writing pressure, pushes the valve plate off of a valve seat.

* * * * *